US011521530B2

(12) United States Patent
Xiao

(10) Patent No.: US 11,521,530 B2
(45) Date of Patent: Dec. 6, 2022

(54) DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventor: Bangqing Xiao, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 276 days.

(21) Appl. No.: 16/766,717

(22) PCT Filed: May 9, 2020

(86) PCT No.: PCT/CN2020/089469
§ 371 (c)(1),
(2) Date: May 25, 2020

(87) PCT Pub. No.: WO2021/212558
PCT Pub. Date: Oct. 28, 2021

(65) Prior Publication Data

US 2022/0122503 A1 Apr. 21, 2022

(30) Foreign Application Priority Data

Apr. 24, 2020 (CN) ..... 202010330926.2

(51) Int. Cl.
*G09G 3/20* (2006.01)
*G09G 3/3266* (2016.01)
*G09G 3/36* (2006.01)

(52) U.S. Cl.
CPC ..... *G09G 3/20* (2013.01); *G09G 3/2003* (2013.01); *G09G 3/3266* (2013.01);
(Continued)

(58) Field of Classification Search
None
See application file for complete search history.

(56) References Cited

U.S. PATENT DOCUMENTS

2008/0049156 A1* 2/2008 Kim ..... G02F 1/136286 349/40
2015/0379951 A1* 12/2015 Zeng ..... G09G 3/3648 345/92

(Continued)

FOREIGN PATENT DOCUMENTS

CN 101131491 A 2/2008
CN 101661173 A 3/2010

(Continued)

*Primary Examiner* — Dorothy Harris
(74) *Attorney, Agent, or Firm* — PV IP PC; Wei Te Chung; Ude Lu

(57) ABSTRACT

A display panel including a gate driver on array (GOA) circuit region is provided. The GOA circuit region includes cascaded n-staged GOA circuit units and N high-frequency clock signal lines; each of the staged GOA circuit units is electrically connected to one of the N high-frequency clock signal lines through a signal connection line; the display panel further includes at least two compensation unit groups, which are positioned in a region where the N high frequency clock signal lines are positioned. By setting a compensation unit in the region where the high-frequency clock signal lines are positioned, a problem of a wider GOA region is solved.

16 Claims, 4 Drawing Sheets

(52) U.S. Cl.
CPC ... *G09G 3/3674* (2013.01); *G09G 2300/0408* (2013.01); *G09G 2300/0876* (2013.01); *G09G 2310/0267* (2013.01); *G09G 2320/0223* (2013.01)

(56) References Cited

U.S. PATENT DOCUMENTS

| | | | | |
|---|---|---|---|---|
| 2016/0365042 | A1 | 12/2016 | Zheng | |
| 2019/0333433 | A1* | 10/2019 | Zhu | G11C 19/28 |
| 2020/0152149 | A1* | 5/2020 | Haga | G09G 3/3677 |

FOREIGN PATENT DOCUMENTS

| | | | |
|---|---|---|---|
| CN | 103745707 | A | 4/2014 |
| CN | 106652957 | A | 5/2017 |
| CN | 109036282 | A | 12/2018 |
| CN | 109741716 | A | 5/2019 |
| KR | 20170126183 | A | 11/2017 |

* cited by examiner

DISPLAY PANEL

FIELD OF INVENTION

The present application relates to the field of display technologies, and in particular to a display panel.

BACKGROUND OF INVENTION

Gate driver on array (GOA) technology is a technology that directly produces gate driver circuits (gate driver ICs) on an array substrate instead of a driver chip made of an external silicon chip. A GOA circuit is fabricated on a substrate around a display region, which simplifies a manufacturing process of a display panel and eliminates a bonding process of scanning lines in a horizontal direction. It can increase production capacity and reduce product cost. At the same time, it can increase integration of the display panel to make it more suitable for making narrow border or borderless display products, and satisfy visual demand of modern consumers.

As size and resolution of display panels continue to increase, especially in large-size 8K products, signal traces of a GOA region are lengthened and loading is increased and will, for example, cause differences between different clock signals (CK signals), which is prone to produce undesirable display phenomena such as horizontally lateral lines. A conventional solution is to install a compensation structure in the GOA circuit region, but adding a new structure will occupy space and is not conducive to narrow border.

Therefore, the conventional technology has defects and needs to be solved urgently.

SUMMARY OF INVENTION

Technical Problem

The present application provides a display panel, which can solve a technical problem that conventional display panels have a wider gate driver on array (GOA) region, which is not conducive to the narrow border design of the panel.

Technical Solution

To solve the above problems, the technical solutions provided by the present application are as follows.

The present application provides a display panel, wherein a display region of the display panel includes a plurality of pixel units distributed in an array, a non-display region of the display panel includes a gate driver on array (GOA) circuit region positioned at at least one side of the display region, and the GOA circuit region includes cascaded n-staged GOA circuit units and N high-frequency clock signal lines extending in a column direction, where n and N are positive integers greater than or equal to 2;

wherein each of the staged GOA circuit units is electrically connected to one of the N high-frequency clock signal lines through a signal connection line, and each of the staged GOA circuit units is correspondingly connected to a row of the pixel units;

wherein a first high-frequency clock signal line to a N-th high-frequency clock signal line in the GOA circuit region are arranged on a side of the display region in sequence from near to far;

wherein the display panel further includes at least two compensation unit groups arranged along the column direction, the compensation unit groups are positioned in a region where the N high-frequency clock signal lines are positioned, and one of the compensation unit groups includes N−1 compensation units; and wherein the first high-frequency clock signal line to a (N−1)th high-frequency clock signal line are electrically connected to the N−1 compensation units in a one-to-one correspondence, wherein the compensation units are positioned at a side away from the display region where the high-frequency clock signal lines are connected to the compensation units.

In the display panel of the present application, the signal connection line and the high-frequency clock signal lines are arranged in different layers, the signal connection line is bridged with one of the high-frequency clock signal lines through a bridge connection, and the compensation units are arranged in a same layer as the signal connection lines and are electrically connected to the signal connection lines.

In the display panel of the present application, the compensation units are in a shape of linear, polyline, comb, curved, spiral, mesh, ring, or strip, or a combination thereof.

In the display panel of the present application, one of the compensation units and the signal connection line connected to a corresponding high-frequency clock signal line are positioned at both sides of the corresponding high-frequency clock signal line, respectively, and the one of the compensation units spans at least one of the high-frequency clock signal lines in a direction crossing the high-frequency clock signal lines.

In the display panel of the present application, a first compensation capacitor is formed between the corresponding high-frequency clock signal line under the one of the compensation units and the one of the compensation units.

In the display panel of the present application, a first compensation capacitance value compensated by the compensation unit corresponding to each of the first high-frequency clock signal line to the (N−1)th high-frequency clock signal line decreases sequentially.

In the display panel of the present application, the display panel further including an electrode layer positioned in the non-display region, the electrode layer correspondingly positioned above the one of the compensation units and having an overlapping region with the one of the compensation units, wherein a second compensation capacitor is formed between the one of the compensation units and the electrode layer.

In the display panel of the present application, a sum the first compensation capacitor and the second compensation capacitor compensated by respective compensation units corresponding to the first high-frequency clock signal line to the (N−1)th high-frequency clock signal line decreases sequentially.

In the display panel of the present application, N signal connection lines corresponding to the first high-frequency clock signal line to the N-th high-frequency clock signal line are a group of repeating units in the signal connection lines, trace lengths of the first high-frequency clock signal line to the N-th high-frequency clock signal line correspondingly connected to the signal connection line are sequentially increased in the group of repeating units.

In the display panel of the present application, trace widths of the one of the compensation units connected correspondingly from the first high-frequency clock signal line to the (N−1)th high-frequency clock signal line are equal in the group of repeating units, and the trace lengths of the one of the compensation units connected correspondingly from the first high-frequency clock signal line to the (N−1)th high-frequency clock signal line are sequentially reduced.

In the display panel of the present application, the trace lengths of the first high-frequency clock signal line to the N-th high-frequency clock signal line correspondingly connected to the signal connection line are equal in the group of repeating units, and the trace widths of the one of the compensation units connected correspondingly from the first high-frequency clock signal line to the (N−1)th high-frequency clock signal line are sequentially increased.

In order to solve the above problems, the present application further provides a display panel, wherein a display region of the display panel includes a plurality of pixel units distributed in an array and a plurality of scan lines, a non-display region of the display panel includes a gate driver on array (GOA) circuit region positioned at at least one side of the display region, and the GOA circuit region includes cascaded n-staged GOA circuit units and N high-frequency clock signal lines extending in a column direction, where n and N are positive integers greater than or equal to 2;

wherein each of the staged GOA circuit units is electrically connected to one of the N high-frequency clock signal lines through a signal connection line, and each of the staged GOA circuit units is correspondingly connected to a row of the pixel units through the scan lines;

wherein a first high-frequency clock signal line to a N-th high-frequency clock signal line in the GOA circuit region are arranged on a side of the display region in sequence from near to far;

wherein the display panel further includes at least two compensation unit groups arranged along the column direction, the compensation unit groups are positioned in a region where the N high-frequency clock signal lines are positioned, and one of the compensation unit groups includes N−1 compensation units; and wherein the first high-frequency clock signal line to a (N−1)th high-frequency clock signal line are electrically connected to the N−1 compensation units in a one-to-one correspondence, wherein the compensation units are positioned at a side away from the display region where the high-frequency clock signal lines are connected to the compensation units.

In the display panel of the present application, the signal connection line and the high-frequency clock signal lines are arranged in different layers, the signal connection line is bridged with one of the high-frequency clock signal lines through a bridge connection, and the compensation units are arranged in a same layer as the signal connection lines and are electrically connected to the signal connection lines.

In the display panel of the present application, the compensation units are in a shape of linear, polyline, comb, curved, spiral, mesh, ring, or strip, or a combination thereof.

In the display panel of the present application, one of the compensation units and the signal connection line connected to a corresponding high-frequency clock signal line are positioned at both sides of the corresponding high-frequency clock signal line, respectively, and the one of the compensation units spans at least one of the high-frequency clock signal lines in a direction crossing the high-frequency clock signal lines.

In the display panel of the present application, the display panel further including an electrode layer positioned in the non-display region, the electrode layer correspondingly positioned above the one of the compensation units and having an overlapping region with the one of the compensation units, wherein a first compensation capacitor is formed between the corresponding high-frequency clock signal line under the one of the compensation units and the one of the compensation units, and a second compensation capacitor is formed between the one of the compensation units and the electrode layer.

In the display panel of the present application, a sum the first compensation capacitor and the second compensation capacitor compensated by respective compensation units corresponding to the first high-frequency clock signal line to the (N−1)th high-frequency clock signal line decreases sequentially.

In the display panel of the present application, N signal connection lines corresponding to the first high-frequency clock signal line to the N-th high-frequency clock signal line are a group of repeating units in the signal connection lines, trace lengths of the first high-frequency clock signal line to the N-th high-frequency clock signal line correspondingly connected to the signal connection line are sequentially increased in the group of repeating units.

In the display panel of the present application, trace widths of the one of the compensation units connected correspondingly from the first high-frequency clock signal line to the (N−1)th high-frequency clock signal line are equal in the group of repeating units, and the trace lengths of the one of the compensation units connected correspondingly from the first high-frequency clock signal line to the (N−1)th high-frequency clock signal line are sequentially reduced.

In the display panel of the present application, the trace lengths of the first high-frequency clock signal line to the N-th high-frequency clock signal line correspondingly connected to the signal connection line are equal in the group of repeating units, and the trace widths of the one of the compensation units connected correspondingly from the first high-frequency clock signal line to the (N−1)th high-frequency clock signal line are sequentially increased.

Beneficial Effect

The beneficial effects of the present application are as follows. The display panel provided by the present application, by providing a compensation unit in the GOA circuit region, the compensation unit can compensate the difference in resistance and capacitance between different clock signals, thereby solving the problem of horizontally lateral lines and other undesirable display phenomena. By setting the compensation unit in the region where the high-frequency clock signal lines are positioned, the problem of a wider GOA region is solved, which is beneficial to the narrow border design of the panel.

BRIEF DESCRIPTION OF FIGURES

The technical solutions and other beneficial effects of the present application will be apparent through the detailed description of the specific implementation of the present application in conjunction with the accompanying drawings.

DETAILED DESCRIPTION OF EMBODIMENTS

Figure 1:
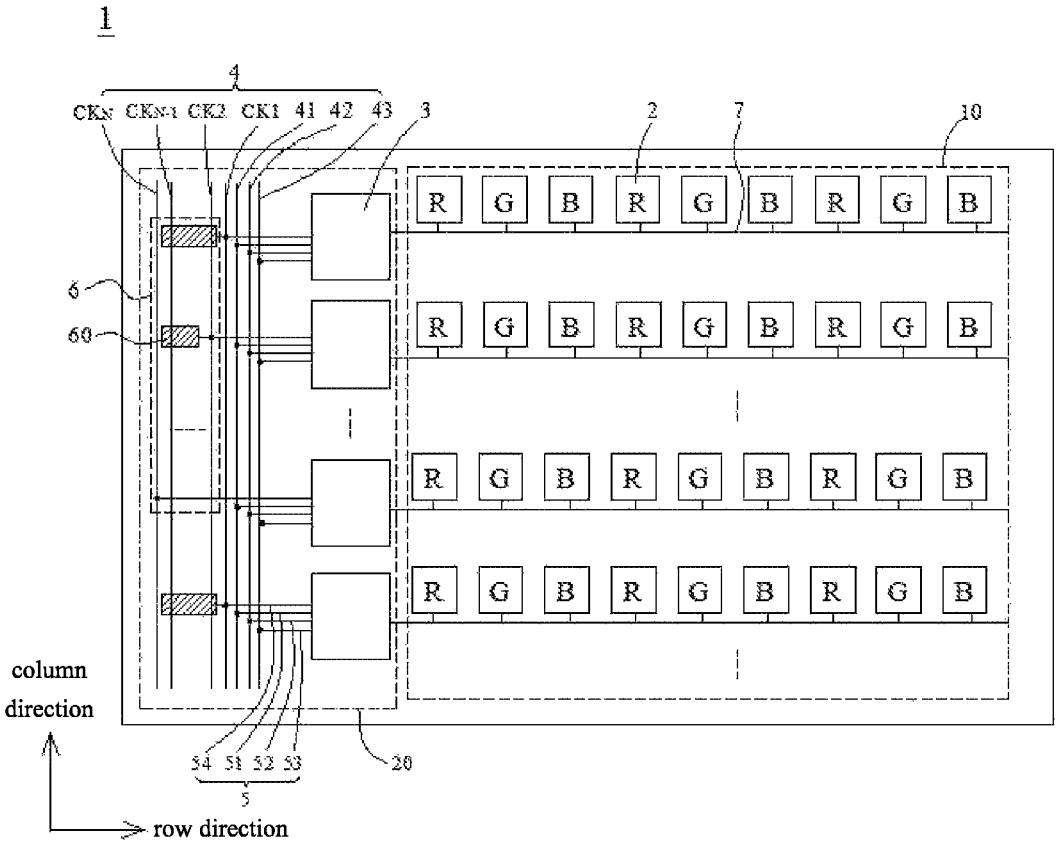
FIG. 1 is a schematic structural diagram of a display panel according to the present application.

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

In the description of the present invention, it is to be understood that the terms such as "longitudinal", "transverse", "length", "width", "upper", "lower", "front", "rear", "left", "right", "vertical", etc., the orientation or positional relationship of the indications is based on the orientation or positional relationship shown in the drawings, and is merely for the convenience of the description of the invention and the simplified description, rather than indicating or implying that the device or component referred to has a specific orientation, in a specific orientation. The construction and operation are therefore not to be construed as limiting the invention. In addition, unless otherwise defined, any technical or scientific term used herein shall have the common meaning understood by a person of ordinary skills. Such words as "first" and "second" used in the specification and claims are merely configured to differentiate different components rather than to represent any order, number or importance. Thus, the features defined as "first," and "second may explicitly or implicitly include one or more of the features. In the description of the present invention, the meaning of "plurality" is two or more unless specifically defined otherwise. In the present application, "I" means "or".

Furthermore, the present application may repeat reference numbers and/or reference letters in different embodiments, and such repetition is for the sake of simplicity and clarity, and does not by itself indicate a relationship between the various embodiments and/or settings discussed.

A gate driver on array (GOA) display panel uses a GOA circuit to drive a display panel for display. The GOA circuit is usually provided on a side or both sides of a display region along a direction of scanning lines. The GOA circuit includes a GOA bus (GOA bus line) and a GOA circuit unit (GOA circuit). The GOA bus includes a plurality of high-frequency clock signal lines, a low-frequency clock signal line, a reset signal line, and a power signal line. Driving signals such as high-frequency clock signals, a low-frequency clock signal, a reset signal, and a power signal outputted by a circuit board need to pass through a corresponding GOA bus to reach the GOA circuit unit, thereby controlling scan lines row by row for display.

However, with the gradual increases of size and resolution of the display panel, for example, the GOA circuit of the large-size 8k products has more signals than an ordinary GOA circuit, and input traces are longer, resulting in a larger resistance-capacitance (RC, impedance) loading of the GOA bus. Due to greater impedance, different resistance-capacitances will cause differences between different high-frequency clock signals (CK signals), causing the panel to produce undesirable display phenomena such as horizontally lateral lines. A general method to reduce the impedance difference between CK signals is to add a resistance compensation structure, but the resistance compensation structure will occupy a certain space in a non-display region, making a width of a GOA circuit region wider, which is not conducive to the narrow border design.

Based on this, the present application provides a display panel to solve the above-mentioned defects.

As shown in FIG. 1, it is a schematic structural diagram of a display panel according to the present application. The display panel 1 includes a plurality of pixel units 2 distributed in an array in a display region 10 and a non-display region positioned at a periphery of the display region 10. The non-display region of the display panel 1 includes a GOA circuit region 20 positioned at at least one side of the display region 10. Exemplarily, the GOA circuit region 20 is positioned at a side or both sides of the display region 10 of the display panel along the direction of the scanning lines. The GOA circuit region 20 includes cascaded n-staged GOA circuit units 3 and a plurality of signal buses 4 extending in a column direction (data line direction), such as a plurality of high-frequency clock signal lines CK, a low-frequency clock signal line 41, a reset signal line 42, and a power signal line 43, etc. In a large-size and high-resolution display panel, many high-frequency clock signal lines are required. The display panel of the present application includes N high-frequency clock signal lines (CK1 . . . $CK_N$), where n and N both are positive integers greater than or equal to 2.

Since the signal buses are configured to transmit different driving signals, each of the staged GOA circuit units 3 needs to be electrically connected to the signal buses 4 through a plurality of signal connection lines 5 in one-to-one correspondence. For example, each GOA circuit unit 3 and the signal buses 4 realize signal transmission through a low-frequency clock signal connection line 51, a reset signal connection line 52, a power signal connection 53, and a high-frequency clock signal connection line 54.

Among them, each staged GOA circuit unit 3 is electrically connected to one of the N high-frequency clock signal lines (CK1 . . . $CK_N$) through the high-frequency clock signal connection line 54. Each staged GOA circuit unit 3 is correspondingly connected to a row of the pixel units 2, and is configured to control the pixel units 2 of the corresponding row.

A first high-frequency clock signal line CK1 to an N-th high-frequency clock signal line $CK_N$ in the GOA circuit region 20 are arranged on a side of the display region 10 in sequence from near to far.

The display panel further includes at least two compensation unit groups 6 arranged along the column direction, the compensation unit groups 6 are positioned in a region where the N high-frequency clock signal lines are positioned, that is, the compensation unit groups 6 do not need to occupy a new layout space separately, so the display panel of the present application will not increase a width of the GOA circuit region 20, which is beneficial to the narrow border design of the display panel.

Each of the compensation unit groups 6 includes a plurality of compensation units 60. Each of the compensation units 60 is correspondingly electrically connected to one of the high-frequency clock signal lines, and the compensation units 60 are positioned at a side away from the display region 10 where the high-frequency clock signal lines are connected to the compensation units.

In the present application, the compensation units are connected to different high-frequency clock signal lines without increasing the width of the GOA circuit region.

Because a high-resolution panel has an increased amount of high-frequency clock signal lines, the traces of the high-frequency clock signal connection line 54 in the GOA circuit region 20 are lengthened, and the loading (resistance-capacitance) is increased. Different resistance-capacitances will cause differences between the high-frequency clock signals (CK signals), causing the panel to produce horizontally lateral lines and other undesirable display phenomena. The compensation unit of the present application can compensate differences between high-frequency clock signals transmitted on different high-frequency clock signal lines.

The following describes the display panel of the present application in detail with reference to specific embodiments.

First Embodiment

Figure 2:
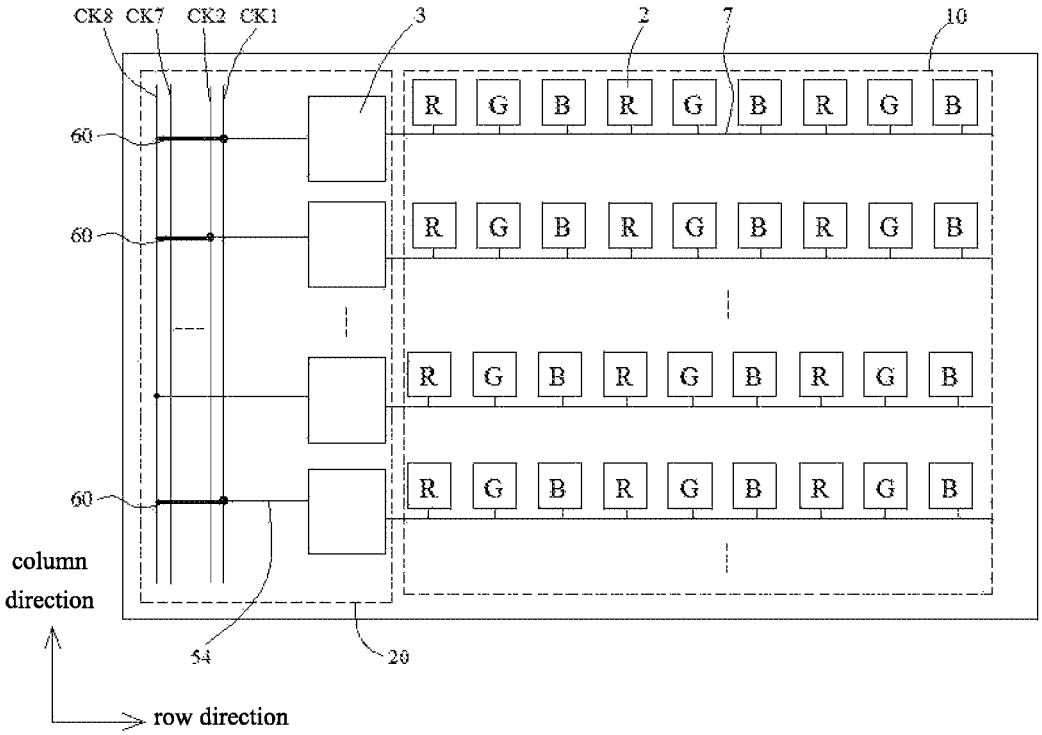
FIG. 2 is a schematic structural diagram of a display panel according to a first embodiment of the present application.

Please refer to FIG. 2, which is a schematic structural diagram of a display panel according to a first embodiment of the present application. It should be noted that, in FIG. 2, for convenience of description, only a plurality of staged high-frequency clock signal lines in a GOA circuit region are shown. The GOA circuit region also includes other signal buses described above, which are not shown in FIG. 2.

In the present embodiment, the GOA circuit region 20 is positioned at a side of the display region 10 of the display panel along the direction of the scanning lines as an example for description. The display region 10 further includes a plurality of scanning lines 7 arranged along a row direction and a plurality of data lines (not shown) arranged along a column direction, and one row of the pixel units 2 are correspondingly connected to one of the scanning lines 7.

The GOA circuit region 20 includes cascaded n-staged GOA circuit units 3 and N high-frequency clock signal lines extending in the column direction. In the present embodiment, the GOA circuit region 20 includes eight high-frequency clock signal lines (CK1 . . . CK8) as an example.

Each staged GOA circuit unit 3 is electrically connected to one of eight high-frequency clock signal lines (CK1 . . . CK8) through one high-frequency clock signal connection line 54, and each staged GOA circuit unit 3 corresponds to one row of the pixel unit 2. The first high-frequency clock signal line CK1 to the eighth high-frequency clock signal line CK8 in the GOA circuit region 20 are arranged on a side of the display region 10 in sequence from near to far. Namely, the first high-frequency clock signal line CK1 is closest to the display region 10, a corresponding trace length of the corresponding high-frequency clock signal connection line 54 is the shortest, and a capacitance-resistance loading generated by the high-frequency clock signal through the corresponding clock signal connection line is smaller. The eighth high-frequency clock signal line CK8 is farthest from the display region 10, a corresponding trace length of the corresponding high-frequency clock signal connection line 54 is the longest, and a capacitance-resistance loading generated by the high-frequency clock signal through the corresponding clock signal connection line is larger.

Figure 3:
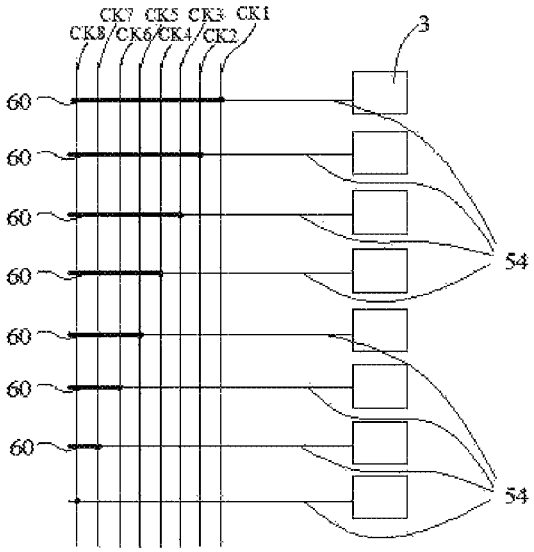
FIG. 3 is a partial enlarged view of the display panel shown in FIG. 2.

The eight high-frequency clock signal connection lines 54 corresponding to the first high-frequency clock signal line CK1 to the eighth high-frequency clock signal line CK8 are a group of repeating units in the signal connection lines 5. With reference to FIG. 3, FIG. 3 is a partially enlarged view of the display panel in FIG. 2. In a group of repeating units, the trace lengths of the high-frequency clock signal connection lines 54 corresponding to the first high-frequency clock signal line CK1 to the eighth high-frequency clock signal line CK8 are sequentially increased. Due to different loading generated on different lengths of the high-frequency clock signal connection lines, the difference in capacitances and resistances between different high-frequency clock signals will be generated on the high-frequency clock signal lines, thereby affecting the display effect.

Referring to FIG. 2 and FIG. 3, one of the compensation unit groups 6 includes N−1 compensation units 60, and the compensation units 60 are positioned in the region where the eight high-frequency clock signal lines (CK1 . . . CK8) are positioned. The compensation units 60 are configured to compensate the difference in capacitance and resistance between high-frequency clock signals on different high-frequency clock signal lines. In other words, the compensation units 60 are configured to compensate the high-frequency clock signals that have a smaller resistance-capacitance load, so that the resistance-capacitance loading between different high-frequency clock signals are same or equivalent, thereby eliminating differences.

Meanwhile, the first high-frequency clock signal line to the (N−1)th high-frequency clock signal line are electrically connected to the N−1 compensation units 60 in one-to-one correspondence, and the compensation units 60 are positioned at a side away from the display region 10 where the high-frequency clock signal lines are connected to the compensation units. Since the resistance-capacitance load of the signal on the eighth high-frequency clock signal line CK8 is the largest, no compensation is needed. Therefore, the first high-frequency clock signal line CK1 to the seventh high-frequency clock signal line CK7 are electrically connected to the seven compensation units 60 in one-to-one correspondence. The resistance-capacitance loading corresponding to the respective signals on the first high-frequency clock signal line CK1 to the seventh high-frequency clock signal line CK7 are consistent with or equal to the resistance-capacitance loading on the eighth high-frequency clock signal line CK8.

In the present embodiment, the signal connection lines 5 and the high-frequency clock signal lines (CK1 . . . CK8) are arranged in different layers, the high-frequency clock signal lines can be made of same material as a gate or an active layer of a thin film transistor in the display region 10, and the signal connection lines 5 can be made of same material as a source/drain of the thin film transistor, or made of same material as an anode layer, which are limited thereto.

In the present embodiment, the high-frequency clock signal connection line 54 is bridged with one of the high-frequency clock signal lines through a bridge connection.

Furthermore, the compensation units 60 are arranged in a same layer as the signal connection lines 54 and are electrically connected to the signal connection lines.

Figure 4:
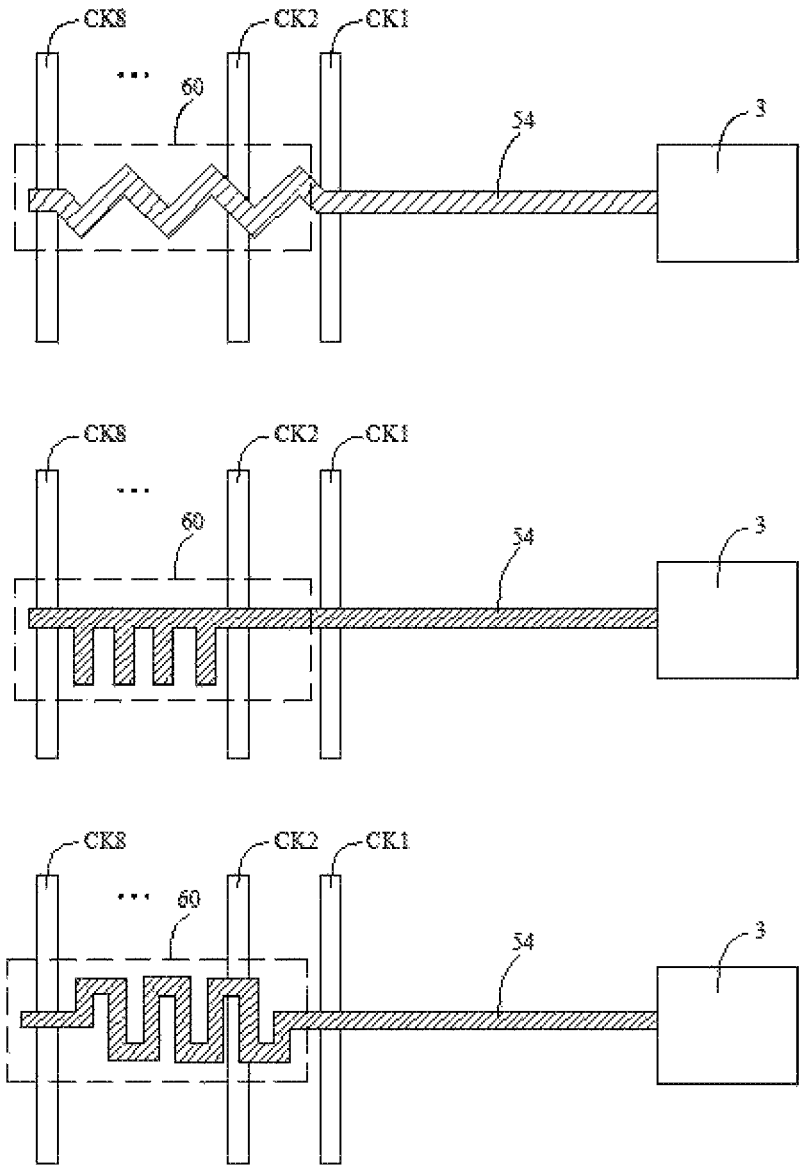
FIG. 4 is a schematic structural diagram of three compensation units and a high-frequency clock signal connection line according to an embodiment of the present application.

The compensation units 60 are in a shape of linear, polyline, comb, curved, spiral, mesh, ring, or strip, or a combination thereof. As shown in FIG. 4, schematic structural diagrams of three types of the compensation units and the high-frequency clock signal connection lines are given, but of course not limited thereto.

In the present embodiment, one of the compensation units 60 and one of the high-frequency clock signal connection lines 54 connected to one of the high-frequency clock signal lines (for example, CK1) are positioned at both sides of the corresponding high-frequency clock signal line, respectively, and the one of the compensation units 60 spans at least one of the high-frequency clock signal lines in a direction crossing the high-frequency clock signal lines (for example, the compensation unit 60 connected by CK1 spans CK2 . . . CK8).

Referring to FIG. 2 and FIG. 3, trace widths of one of the compensation units 60 connected correspondingly from the first high-frequency clock signal line CK1 to the (N−1)th high-frequency clock signal line (CK7) are equal in the group of repeating units, and trace lengths of the one of the compensation units 60 connected correspondingly from the first high-frequency clock signal line CK1 to the (N−1)th high-frequency clock signal line (CK7) are sequentially reduced.

Since the trace lengths of the high-frequency clock signal connection lines 54 corresponding to the first high-frequency clock signal line CK1 to the eighth high-frequency clock signal line CK8 are sequentially increased, the resistance-capacitance loading of the first high-frequency clock signal to the eighth high-frequency clock signal also increase in sequence, and the trace lengths of the one of the compensation units 60 connected correspondingly from the first high-frequency clock signal line CK1 to the seventh high-frequency clock signal line CK7 are sequentially reduced. That is, the trace length of the compensation unit 60 connected to the first high-frequency clock signal line CK1 is the longest, and the trace length of the compensation unit 60 connected to the seventh high-frequency clock signal line CK7 is the shortest, so as to compensate the difference in resistance loading between different high-frequency clock signals caused by the different lengths of the high-frequency clock signal connection lines connected to the different high-frequency clock signal lines.

Furthermore, in a group of repeating units of the high-frequency clock signal connection lines 54, a sum of the trace length of the compensation unit 60 and a length of the corresponding high-frequency clock signal connection line 54 is equal to or close to the trace length of the high-frequency clock signal connection line 54 corresponding to the eighth high-frequency clock signal line CK8. Since the high-frequency clock signal on the high-frequency clock signal line is transmitted to the compensation unit 60 and the high-frequency clock signal connection line 54 on opposite sides through the bridge connection, respectively, therefore, the difference in resistance between different high-frequency clock signals is balanced.

In another embodiment, in a group of repeating units of the high-frequency clock signal connection lines 54, the trace lengths of the first high-frequency clock signal line CK1 to the (N−1)th high-frequency clock signal line (CK7) correspondingly connected to the compensation unit 60 are equal, and the trace widths of the compensation unit 60 connected correspondingly from the first high-frequency clock signal line CK1 to the (N−1)th high-frequency clock signal line (CK7) are sequentially increased, thereby balancing the resistance difference between different high frequency clock signals.

The resistance compensation structure of a conventional display panel can only compensate the difference in resistance between different high-frequency clock signals by winding. However, the difference in capacitance between different high-frequency clock signals is ignored, and a problem of the difference in resistance-capacitance (RC) loading between different high-frequency clock signals cannot be completely solved, thus a problem of a poor display of the display panel cannot be improved very well.

Another object of the present application is to solve the difference in capacitance between different high-frequency clock signals, thereby to eliminate problem of the difference in the resistance-capacitance loading between different high-frequency clock signals to the greatest extent.

Specifically, as described above, since the compensation unit 60 spans at least one of the high-frequency clock signal lines in the direction crossing the high-frequency clock signal lines, therefore, a first compensation capacitator is formed between the compensation unit 60 and the corresponding high-frequency clock signal line under the compensation unit 60. Since the trace lengths of the first high-frequency clock signal line CK1 to the seventh high-frequency clock signal line CK7 correspondingly connected to the compensation unit 60 become sequentially shorter, and since the trace of the compensation unit 60 connected to the first high-frequency clock signal line CK1 spans the largest number of other high-frequency clock signal lines (for example, CK2 . . . CK8), therefore a formed first compensation capacitance value is also larger; the trace of the compensation unit 60 connected to the seventh high-frequency clock signal line CK7 spans the least number of other high-frequency clock signal lines (for example, CK8), therefore the formed first compensation capacitance value is also smaller.

That is, the first compensation capacitance value compensated by the compensation unit 60 corresponding to each of the first high-frequency clock signal line CK1 to the (N−1)th high-frequency clock signal line (CK7) decreases sequentially.

Since the trace lengths of the high-frequency clock signal connection lines 54 corresponding to the first high-frequency clock signal line CK1 to the eighth high-frequency clock signal line CK8 are sequentially increased, the capacitive loading of the first high-frequency clock signal to the eighth high-frequency clock signal are also sequentially increased, therefore the trace lengths of the first high-frequency clock signal line CK1 to the seventh high-frequency clock signal line CK7 correspondingly connected to the compensation unit 60 are sequentially reduced (that is, the compensated first compensation capacitance value decreases in sequence). Therefore, the difference in the capacitive loading between different high-frequency clock signals caused by different lengths of the high-frequency clock signal connecting lines connected to the different high-frequency clock signal lines is compensated.

Furthermore, in a group of repeating units of the high-frequency clock signal connection lines 54, the first compensation capacitance value compensated by one of the compensation units 60 is equal to or close to a value of different capacitive loading between the high-frequency clock signal corresponding to the one of the compensation units 60 and the high-frequency clock signal corresponding to the eighth high-frequency clock signal line CK8. Since the high-frequency clock signal on the high-frequency clock signal line is transmitted to the one of the compensation units 60 and the high-frequency clock signal connection line 54 on opposite sides through the bridge connection, respectively, the difference in capacitance between different high-frequency clock signals is balanced.

In an embodiment, the display panel further includes an electrode layer positioned in the non-display region. The electrode layer can be a common electrode layer, but not limited thereto. The electrode layer is correspondingly positioned above the one of the compensation units 60 and has an overlapping region with the one of the compensation units 60, wherein a second compensation capacitor is formed between the one of the compensation units 60 and the electrode layer.

Furthermore, the first compensation capacitor and the second compensation capacitor form a capacitance superposition, and the compensation unit 60 compensates the capacitance difference between different high-frequency clock signals with a superimposed compensation capacitor. In a group of repeating units of the high-frequency clock signal connection lines 54, a sum the first compensation capacitor and the second compensation capacitor compensated by respective compensation units 60 corresponding to the first high-frequency clock signal line CK1 to the (N−1)th high-frequency clock signal line (CK7) decreases sequentially.

Furthermore, the sum of the first compensation capacitor and the second compensation capacitor compensated by the compensation unit 60 is numerically equal to or close to a different value in the capacitive loading between the high-frequency clock signal corresponding to the compensation unit 60 and the high-frequency clock signal corresponding to the eighth high-frequency clock signal line CK8. Therefore, the capacitance difference between different high-frequency clock signals is balanced.

The display panel of the present embodiment can eliminate the difference in resistance and capacitance between different high-frequency clock signals to the greatest extent through the above-mentioned design, and can reduce the width of the GOA circuit region compared to the conventional resistance compensation structure, which is beneficial to the narrow border design of the display panel.

Second Embodiment

Figure 5:
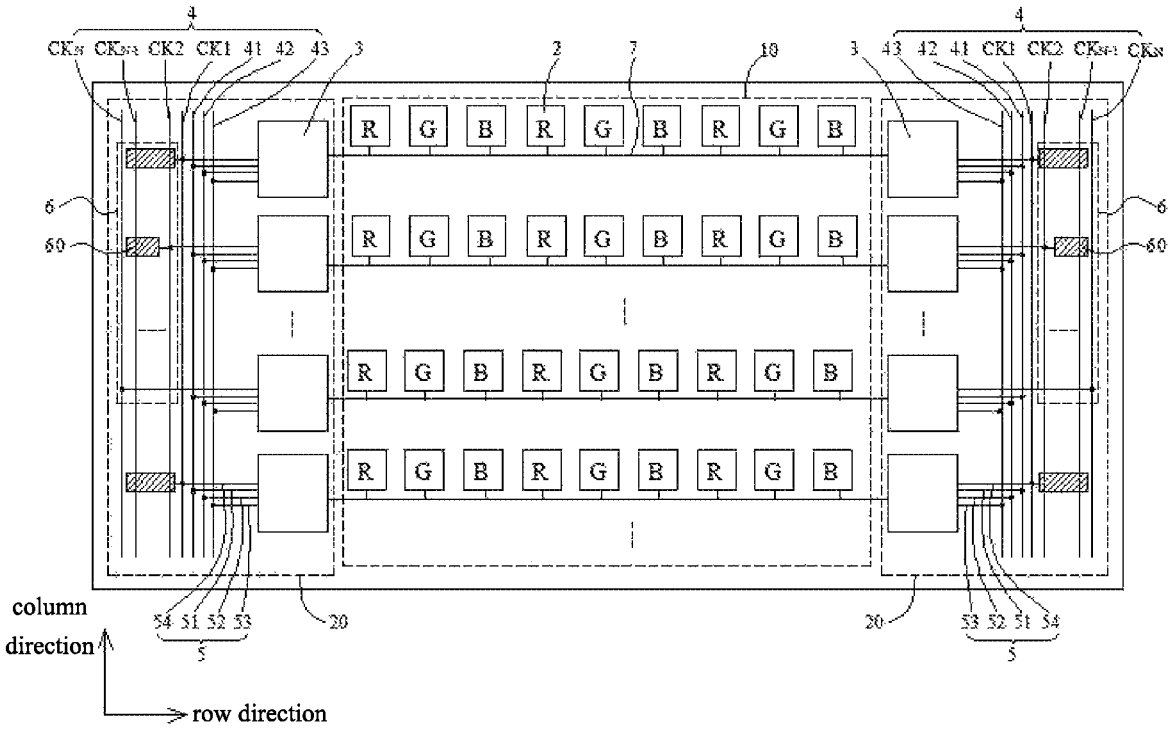
FIG. 5 is a schematic structural diagram of a display panel according to a second embodiment of the present application.

As shown in FIG. 5, it is a schematic structural diagram of a display panel according to a second embodiment of the present application. The display panel of the present embodiment has the same/similar structure as the display panel in the first embodiment above, except that the display panel of the present embodiment is a dual-driving type display panel, that is, the GOA circuit region 20 is positioned on both sides of the display region 10 along the direction of the scanning lines of the display panel. That is, the display panel includes two sets of GOA circuits, each set of GOA circuits includes cascaded n-staged GOA circuit units 3 and N high-frequency clock signal lines, and further includes the compensation unit groups 6. Both of the GOA circuit regions 20 include the compensation unit groups 6, and the specific design of the compensation unit groups 6 is consistent with the design in the first embodiment described above, which will not be repeated here. Among them, each of the staged GOA circuit units 3 is correspondingly connected to a scanning line 7.

Since the display panel of the present embodiment drives the row of pixel units 2 from both sides at the same time, the driving capability is stronger than that of single-sided driving. In addition, since the compensation unit can simultaneously compensate the difference in resistance and capacitance between different high-frequency clock signals from both sides of the panel, layout design of the compensation unit on a side of the GOA circuit region can be shared, and also reducing the resistance-capacitance loading of high-frequency clock signals.

Third Embodiment

Figure 6:
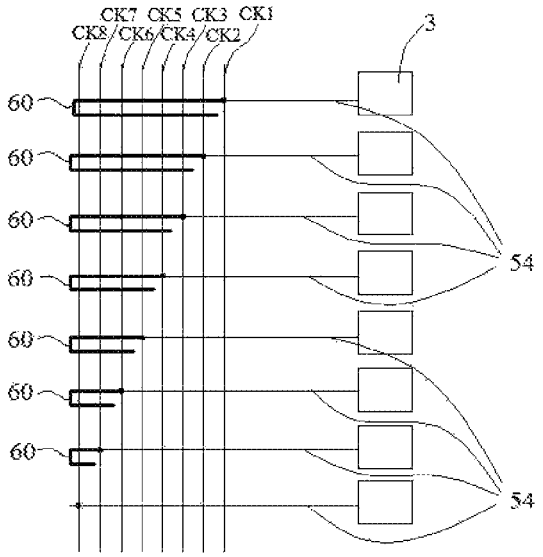
FIG. 6 is a partial schematic structural diagram of a display panel according to a third embodiment of the present application.

As shown in FIG. 6, it is a partial structural schematic diagram of a display panel according to a third embodiment of the present application. The display panel of the present embodiment has a same/similar structure as the display panel in the first embodiment above, the only difference is that: the winding mode of the compensation unit 60 in the present embodiment is a circuitous design. This method can further increase the trace length of the compensation unit 60 and the number of times of crossing other high-frequency clock signal lines, and further increase the compensation capability of the compensation unit 60 in the resistance and capacitance.

In the display panel of the present application, by providing a compensation unit in the GOA circuit region, the compensation unit can compensate the difference in resistance and capacitance between different clock signals, thereby solving the problem of horizontally lateral lines and other undesirable display phenomena. By setting the compensation unit in the region where the high-frequency clock signal lines are positioned, the problem of a wider GOA region is solved, which is beneficial to the narrow border design of the panel.

Embodiments of the present invention have been described, but not intended to impose any unduly constraint to the appended claims. For a person skilled in the art, any modification of equivalent structure or equivalent process made according to the disclosure and drawings of the present invention, or any application thereof, is considered encompassed in the scope of protection defined by the claims of the present invention.

What is claimed is:

1. A display panel, wherein a display region of the display panel comprises a plurality of pixel units distributed in an array, a non-display region of the display panel comprises a gate driver on array (GOA) circuit region positioned at at least one side of the display region, and the GOA circuit region comprises cascaded n-staged GOA circuit units and N high-frequency clock signal lines extending in a column direction, where n and N are positive integers greater than or equal to 2;

wherein each of the staged GOA circuit units is electrically connected to one of the N high-frequency clock signal lines through a signal connection line, and each of the staged GOA circuit units is correspondingly connected to a row of the pixel units;

wherein a first high-frequency clock signal line to an N-th high-frequency clock signal line in the GOA circuit region are arranged on the side of the display region in sequence from near to far;

wherein the display panel further comprises at least two compensation unit groups arranged along the column direction, the compensation unit groups are positioned in a region where the N high-frequency clock signal lines are positioned, and one of the compensation unit groups comprises N−1 compensation units;

wherein the first high-frequency clock signal line to an (N−1)th high-frequency clock signal line are electrically connected to the N−1 compensation units in a one-to-one correspondence, wherein the compensation units are positioned at a side away from the display region where the high-frequency clock signal lines are connected to the compensation units;

wherein the signal connection line and the high-frequency clock signal lines are arranged in different layers, the signal connection line is bridged with one of the high-frequency clock signal lines through a bridge connection, and the compensation units are arranged in a same layer as the signal connection lines and are electrically connected to the signal connection lines;

wherein one of the compensation units and the signal connection line connected to a corresponding high-frequency clock signal line are respectively positioned at two opposite sides of the corresponding high-frequency clock signal line, and the one of the compensation units spans at least one of the high-frequency clock signal lines in a direction crossing the high-frequency clock signal lines; and wherein a first compensation capacitator is formed between the one of the compensation units and the corresponding high-frequency clock signal line under the one of the compensation units.

2. The display panel according to claim 1, wherein the compensation units are in a shape of linear, polyline, comb, curved, spiral, mesh, ring, or strip, or a combination thereof.

3. The display panel according to claim 1, wherein a first compensation capacitance value compensated by the compensation unit corresponding to each of the first high-frequency clock signal line to the (N−1)th high-frequency clock signal line decreases sequentially.

4. The display panel according to claim 1, further comprising an electrode layer positioned in the non-display region, the electrode layer positioned correspondingly above the one of the compensation units and having an overlapping region with the one of the compensation units, wherein a second compensation capacitor is formed between the one of the compensation units and the electrode layer.

5. The display panel according to claim 4, wherein a sum of the first compensation capacitor and the second compensation capacitor compensated by respective compensation units corresponding to the first high-frequency clock signal line to the (N−1)th high-frequency clock signal line decreases sequentially.

6. The display panel according to claim 1, wherein N signal connection lines corresponding to the first high-frequency clock signal line to the N-th high-frequency clock signal line are a group of repeating units in the signal connection line, and trace lengths of the first high-frequency clock signal line to the N-th high-frequency clock signal line correspondingly connected to the signal connection line are sequentially increased in the group of repeating units.

7. The display panel according to claim 6, wherein trace widths of the one of the compensation units connected correspondingly from the first high-frequency clock signal line to the (N−1)th high-frequency clock signal line are equal in the group of repeating units, and trace lengths of the one of the compensation units connected correspondingly from the first high-frequency clock signal line to the (N−1)th high-frequency clock signal line are sequentially reduced.

8. The display panel according to claim 6, wherein the trace lengths of the first high-frequency clock signal line to the N-th high-frequency clock signal line correspondingly connected to the signal connection line are equal in the group of repeating units, and trace widths of the one of the compensation units connected correspondingly from the first high-frequency clock signal line to the (N−1)th high-frequency clock signal line are sequentially increased.

9. A display panel, wherein a display region of the display panel comprises a plurality of pixel units distributed in an array and a plurality of scan lines, a non-display region of the display panel comprises a gate driver on array (GOA) circuit region positioned at at least one side of the display region, and the GOA circuit region comprises cascaded n-staged GOA circuit units and N high-frequency clock signal lines extending in a column direction, where n and N are positive integers greater than or equal to 2;

wherein each of the staged GOA circuit units is electrically connected to one of the N high-frequency clock signal lines through a signal connection line, and each of the staged GOA circuit units is correspondingly connected to a row of the pixel units through the scan lines;

wherein a first high-frequency clock signal line to an N-th high-frequency clock signal line in the GOA circuit region are arranged on the side of the display region in sequence from near to far;

wherein the display panel further comprises at least two compensation unit groups arranged along the column direction, the compensation unit groups are positioned in a region where the N high-frequency clock signal lines are positioned, and one of the compensation unit groups comprises N−1 compensation units;

wherein the first high-frequency clock signal line to an (N−1)th high-frequency clock signal line are electrically connected to the N−1 compensation units in a one-to-one correspondence, wherein the compensation units are positioned at a side away from the display region where the high-frequency clock signal lines are connected to the compensation units;

wherein the signal connection line and the high-frequency clock signal lines are arranged in different layers, the signal connection line is bridged with one of the high-frequency clock signal lines through a bridge connection, and the compensation units are arranged in a same layer as the signal connection lines and are electrically connected to the signal connection lines;

wherein one of the compensation units spans at least one of the high-frequency clock signal lines in a direction crossing the high-frequency clock signal lines; and wherein a first compensation capacitator is formed between the one of the compensation units and the corresponding high-frequency clock signal line under the one of the compensation units.

10. The display panel according to claim 9, wherein the compensation units are in a shape of linear, polyline, comb, curved, spiral, mesh, ring, or strip, or a combination thereof.

11. The display panel according to claim 9, wherein one of the compensation units and the signal connection line connected to a corresponding high-frequency clock signal line are respectively positioned at two opposite sides of the corresponding high-frequency clock signal line.

12. The display panel according to claim 9, further comprising an electrode layer positioned in the non-display region, the electrode layer correspondingly positioned above the one of the compensation units and having an overlapping region with the one of the compensation units, wherein a second compensation capacitor is formed between the one of the compensation units and the electrode layer.

13. The display panel according to claim 12, wherein a sum of the first compensation capacitor and the second compensation capacitor compensated by respective compensation units corresponding to the first high-frequency clock signal line to the (N−1)th high-frequency clock signal line decreases sequentially.

14. The display panel according to claim 9, wherein N signal connection lines corresponding to the first high-frequency clock signal line to the N-th high-frequency clock signal line are a group of repeating units in the signal connection line, and trace lengths of the first high-frequency clock signal line to the N-th high-frequency clock signal line correspondingly connected to the signal connection line are sequentially increased in the group of repeating units.

15. The display panel according to claim 14, wherein trace widths of the one of the compensation units connected correspondingly from the first high-frequency clock signal line to the (N−1)th high-frequency clock signal line are equal in the group of repeating units, and trace lengths of the one of the compensation units connected correspondingly from the first high-frequency clock signal line to the (N−1)th high-frequency clock signal line are sequentially reduced.

16. The display panel according to claim 14, wherein the trace lengths of the first high-frequency clock signal line to the N-th high-frequency clock signal line correspondingly connected to the signal connection line are equal in the group of repeating units, and trace widths of the one of the compensation units connected correspondingly from the first high-frequency clock signal line to the (N−1)th high-frequency clock signal line are sequentially increased.

* * * * *